US009267349B2

(12) United States Patent
Fenton

(10) Patent No.: US 9,267,349 B2
(45) Date of Patent: Feb. 23, 2016

(54) PLUG TOOLING PACKAGE WITH INTEGRATED SEQUENCE VALVES

(71) Applicant: Vetco Gray U.K., Limited, Houston, TX (US)

(72) Inventor: Stephen Paul Fenton, Aberdeen (GB)

(73) Assignee: Vetco Gray U.K., Limited, Houston, TX (US)

( * ) Notice: Subject to any disclaimer, the term of this patent is extended or adjusted under 35 U.S.C. 154(b) by 272 days.

(21) Appl. No.: 13/731,148

(22) Filed: Dec. 31, 2012

(65) Prior Publication Data

US 2014/0182858 A1 Jul. 3, 2014

(51) Int. Cl.

| | |
|---|---|
| ***E21B 33/12*** | (2006.01) |
| ***E21B 33/08*** | (2006.01) |
| ***E21B 33/06*** | (2006.01) |
| ***E21B 33/035*** | (2006.01) |
| ***E21B 23/04*** | (2006.01) |
| ***E21B 33/076*** | (2006.01) |

(52) U.S. Cl.

CPC ..... *E21B 33/035* (2013.01); *E21B 23/04* (2013.01); *E21B 33/0355* (2013.01); *E21B 33/076* (2013.01)

(58) Field of Classification Search

None

See application file for complete search history.

(56) References Cited

U.S. PATENT DOCUMENTS 6,719,059 B2 4/2004 Dezen et al.
7,121,344 B2 * 10/2006 Fenton ..... E21B 19/002 166/106

* cited by examiner

*Primary Examiner* — Matthew R Buck
*Assistant Examiner* — Douglas S Wood
(74) *Attorney, Agent, or Firm* — Bracewell & Giuliani LLP

(57) ABSTRACT

A device and method of handling a plug in a tubing hanger includes a pressure actuated sequence valve that has multiple outlets. Hydraulic fluid from a remotely operated vehicle (ROV) provides hydraulic fluid that selectively flows through the valve for operating a tool that handles the plug. The valve outlets are ported to separate lines for operating different functions of the tool. Flow to a specific outlet occurs by sequencing the valve to a corresponding position, where the valve is sequenced by changing pressure of the hydraulic fluid. The sequence valve is disposed in a piston that is axially movable within the tool. A stroking rod attaches to the piston, and is actuated by diverting flow to sides of the piston.

19 Claims, 4 Drawing Sheets

PLUG TOOLING PACKAGE WITH INTEGRATED SEQUENCE VALVES

BACKGROUND

1. Field of Invention

The present disclosure relates in general to a system for controlling operation of a subsea device. More specifically, the present disclosure relates to a pressure actuated sequencing valve assembly that selectively delivers fluid to a plug handling device.

2. Description of Prior Art

Subsea wells typically include a wellhead housing located on the sea floor; which are lined with one or more casing strings. Casing hangers are mounted in the wellhead housing for supporting the casing strings. In one type of wellhead assembly, a tubing hanger located at the upper end of a string of tubing is installed in the wellhead housing. After the tubing has been installed, the well can be perforated and a production tree landed on the wellhead housing. A plug is usually inserted into the production passage of the tubing hanger to temporarily seal the well when the production tree is being installed on the wellhead housing. Production trees have a number of valves for controlling the well fluid. Trees also have a production flow passage and an isolation sub that stabs into the production passage of the tubing hanger. The plug is generally removed by lowering a tool through the production flow passage of the tree. For a workover operation involving pulling of the tubing hanger, the tree must be disconnected from the wellhead housing. If the tree needed to be retrieved for repair work, this can be done without pulling the tubing.

In another type of wellhead assembly, the tree is installed on the wellhead housing before running the tubing. Here the drilling riser connects to the tree, and the tubing hanger is lowered through the drilling riser and lands in the tree. The tubing hanger has a lateral flow outlet that registers with a lateral flow outlet in the tree. In this type of wellhead assembly, the plug is set in the tubing hanger vertical bore above the flow outlet. The tree does not need to be disconnected from the wellhead housing for pulling the tubing for a workover operation. If the tree needed to be retrieved for repair, the tubing would have to be pulled.

In the various configurations described above, the tree is a large, heavy and complex assembly conventionally run on a string of drill pipe. The running procedure requires a vessel with a derrick. It may not be economical to utilize the same vessel that drilled the well to complete the well and install the tree. Designs for trees that can be run on a lift line are known.

SUMMARY OF THE INVENTION

Disclosed herein is a tool for handling a plug in a subsea wellhead assembly. In one example the tool includes an end effector having a latch in selective engagement with the plug and a coupling assembly in selective mechanical cooperation with a latch assembly in the plug. A pressure controlled sequence valve is included in this example that has a valve body, an inlet in the valve body that is in fluid communication with a fluid source, a latch outlet in the valve body that is in fluid communication with the latch, a coupling assembly outlet in the valve body that is in fluid communication with the latch assembly, and a pilot that is selectively sequenced to a position where there is fluid communication between the inlet and the latch outlet and to a position where there is fluid communication between the inlet and coupling assembly outlet. The pilot can be in fluid communication with the fluid source, and wherein the position of the pilot corresponds to a pressure of the fluid in the fluid source. The fluid source can be a remotely operated vehicle and can supply fluid at selective pressures. In an example, the valve body includes a power supply valve body, and the tool further includes, a vent valve body having a latch inlet in the valve body that is in fluid communication with the latch, a coupling assembly inlet in the valve body that is in fluid communication with the coupling assembly, an outlet in fluid communication with a storage tank, and a pilot that is selectively sequenced to a position where there is fluid communication between the outlet and the latch inlet and to a position where there is fluid communication between the outlet and coupling assembly inlet. In this example, when fluid flows from the power supply valve body, fluid is urged from a chamber in the end effector and routed to an inlet of the vent valve body that is in fluid communication with the outlet of the vent valve body. The tool can further have a body, a chamber in the body that defines a cylinder that is in selective fluid communication with the fluid source, a piston movably disposed within the cylinder, and a stem connected between the piston and the end effector, so that when fluid is introduced into the cylinder the end effector is axially movable with movement of the piston. The sequence valve can be disposed in the piston. Optionally, the latch outlet is an actuating latch outlet, and the tool can also have a de-actuating latch outlet in the valve body that is in fluid communication with the latch, so that when the sequence valve is positioned with the inlet in fluid communication with the actuating latch outlet, fluid flows to the latch to couple the plug to the end effector, and so that when the sequence valve is positioned with the inlet in fluid communication with the de-actuating latch outlet, fluid flows to the latch to decouple the plug from the end effector. The coupling assembly outlet can be a locking actuator outlet and the tool can further include an unlocking actuator outlet in the valve body that is in fluid communication with the coupling assembly, so that when the sequence valve is positioned with the inlet in fluid communication with the locking actuator outlet, fluid flows to the coupling assembly to anchor the plug to a tubing hanger, and so that when the sequence valve is positioned with the inlet in fluid communication with the unlocking actuator outlet, fluid flows to the coupling assembly to disengage the plug from the tubing hanger.

Also provided herein is a method of handling a plug in a subsea wellhead assembly. In an example the method includes providing a plug handling tool having a plug latch, a plug anchor system, and a pressure actuated power supply valve that has an inlet, an outlet in communication with a plug latch actuator, and an outlet in communication with a plug anchor system. The method further includes coupling the plug to the plug handling tool by supplying fluid to the power supply valve at a pressure that sequences the power supply valve to a position so the inlet is in communication with the outlet in communication with the plug latch actuator, inserting the plug into the subsea wellhead assembly, and anchoring the plug in the subsea wellhead assembly. Anchoring the plug is done in this example by supplying fluid to the power supply valve at a pressure that sequences the power supply valve to a position so the inlet is in communication with the outlet in communication with the plug anchor system. The method can further include providing a vent valve having an inlet in communication with the plug latch actuator, an inlet in communication with the plug anchor, and an outlet in communication with a storage tank, and that is sequenced in response to the supply of fluid. The method may further include selectively venting fluid through the vent valve to storage, wherein the fluid is evacuated from the plug latch actuator response to fluid flowing from the power supply valve. Fluid can optionally be supplied by a remotely operated vehicle disposed subsea. The tool included with the method can further have a tool body with a chamber, a piston in the chamber, a stem connecting the piston to an end effector that couples to the plug; in this example the method further includes supplying fluid in the chamber to selectively move the piston, stem, and end effector in an axial direction.

Another embodiment of a tool for handling a plug in a subsea wellhead assembly is provided herein that includes a tool body having a cavity that is in fluid communication with a remotely operated vehicle (ROV), an end effector coupled with the tool body having a plug latch system and a plug anchoring system, a piston axially movable within the cavity, and a sequence valve system in the piston. In this example, the sequence valve includes a power supply valve having an inlet, a first outlet and a second outlet respectively in fluid communication with the plug latch system and the plug anchoring system, and a pilot member selectively sequenced in response to a pressure of fluid supplied by the ROV to a first position where the inlet is in communication with the first outlet and to a second position where the inlet is in communication with the second outlet. The sequence valve further includes a vent valve having an outlet, a first inlet and a second inlet respectively in fluid communication with the plug latch system and the plug anchoring system, and a pilot member selectively sequenced in response to a pressure of fluid supplied by the ROV to a first position where the outlet is in communication with the first inlet and to a second position where the outlet is in communication with the second inlet. The tool can further include a stem mounted on an end of the piston that attaches to the end effector, so that when fluid is supplied to aside of the piston, the stem and the end effector are axially moved. The plug latch system can be elongated latching fingers that attach to the plug when fluid flows from the first outlet. Optionally, the plug anchoring system includes members that selectively extend radially outward when fluid flows from the second outlet.

BRIEF DESCRIPTION OF DRAWINGS

Some of the features and benefits of the present invention having been stated, others will become apparent as the description proceeds when taken in conjunction with the accompanying drawings, in which.

Figure 2:
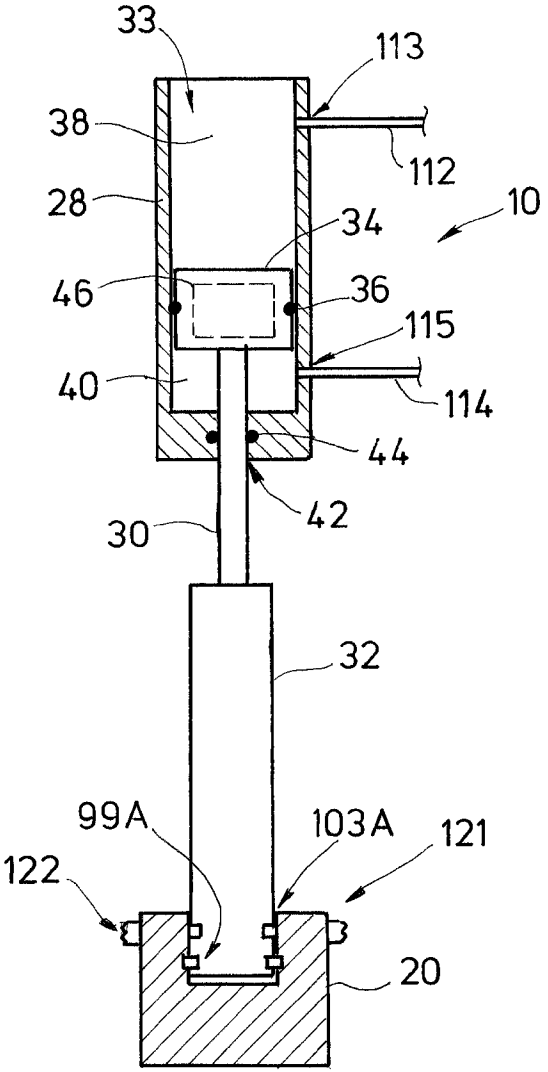
FIG. 2 is a partial side sectional view of the plug tooling package of FIG. 1 in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
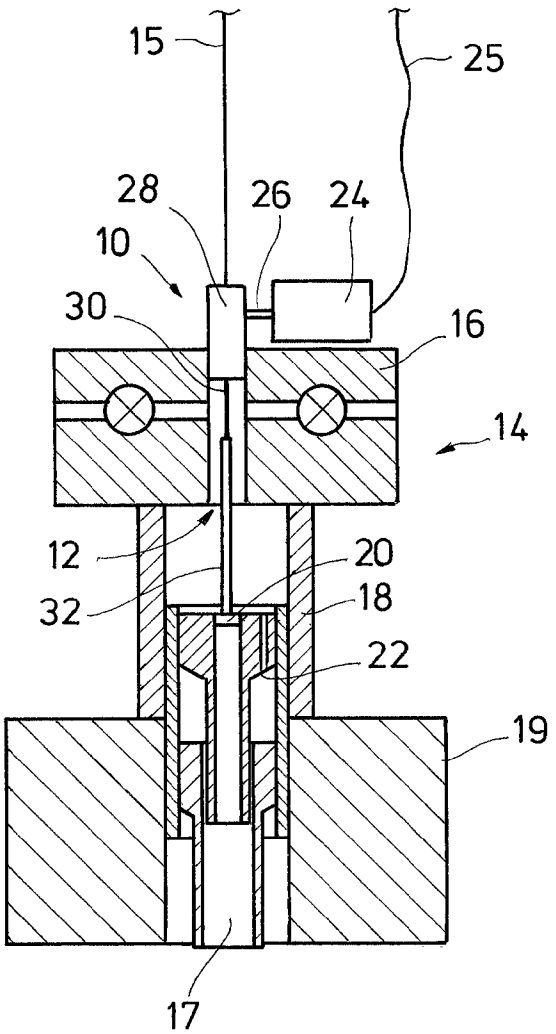
FIG. 1 is a partial side sectional view of an example embodiment of a plug package handling a plug in a wellhead assembly and in accordance with the present invention.

An example embodiment of a plug handling tool 10 is illustrated in a partial side sectional view in FIG. 1 being inserted into a main bore 12 of a wellhead assembly 14. The plug handling tool 10 is being lowered subsea on an end of a wire line 15. The wellhead assembly 14 includes a production tree 16 having valves and lines for porting fluids produced from a wellbore 17 shown below the wellhead assembly 14. The production tree 16 is mounted on a wellhead housing 18 which is anchored into the sea floor 19. A plug 20 is shown attached on a lower end of the plug handling tool 10 and disposed where the main bore 12 passes through a tubing hanger 22 supported within the wellhead assembly 14. Thus, in one example, handling by the plug handling tool 10 includes lowering the plug 20 subsea into the tubing hanger 22 and coupling the plug 20 to the tubing hanger 22. Handling by the plug handling tool 10 can include removing the plug 20 from the tubing hanger 22 and raising the plug 20 to the sea surface.

When subsea, in an example, control of the plug handling tool 10 can be done through a remote operating vehicle (ROV) 24 shown having an attached control line 25 for sending and receiving commands to the ROV 24 from surface. Other examples include an umbilical, skid based sea bottom mounted power packs, and the like. Further in the example of FIG. 1, the ROV 24 communicates with the plug handling tool via a control line 26. The control line 26 extends from ROV 24 into a receptacle (not shown) provided on an outer surface of a main tool body 28 that houses components of the plug handling tool 10. As shown, the main tool body 28 anchors to the wellhead assembly 14 so that a portion of the main tool body 28 extends into the production tree 16. A stem 30 depends from the main tool body 28 deeper into the bore 12 having on its end distal from the main tool body 28 an attached end effector 32. The plug 20 mounts on an end of the end effector 32 that is distal from stem 30. Once anchored in the wellhead assembly 14, the stem 30 can be reciprocated into and outside of the main tool body 28 for discrete positioning of the plug 20 in and out of the tubing hanger 22.

An example of the plug handling tool 10 is shown in a partial side sectional view in FIG. 2, where a cavity 33 is included within the main tool body 28. A piston 34 is depicted axially movable within the cavity 33 and having an end attached to the stem 30. Seals 36 on an outer periphery of the piston 34 define an upper chamber 38 in the cavity 33 on a side of the piston 34 distal from stem 30. Seals 36 define a lower chamber 40 in the cavity 33 on a side of the piston 34 that attaches to stein 30. A bore 42 is shown formed axially through a lower end of main tool body 28 and provides a pathway for stem 30 to extend from within the cavity 33 to its connection with the end effector 32. Selectively pressurizing one of the upper or lower chambers 38, 40 urges piston 34 axially within cavity 33, thereby moving stem 30, end effector 32, and plug 20 into a designated location. Seals 44 are shown mounted in bore 42 for providing a fluid barrier along the interface between stem 30 and bore 42. Further schematically illustrated in FIG. 2 is a sequence valve 46 disposed in piston 34. Described in more detail below, the sequence valve 46 is selectively pressure controlled to deliver hydraulic fluid to components within the end effector 32 for attaching and/or releasing from plug 20, and also for actuating an anchoring system within plug 20.

Figure 3:
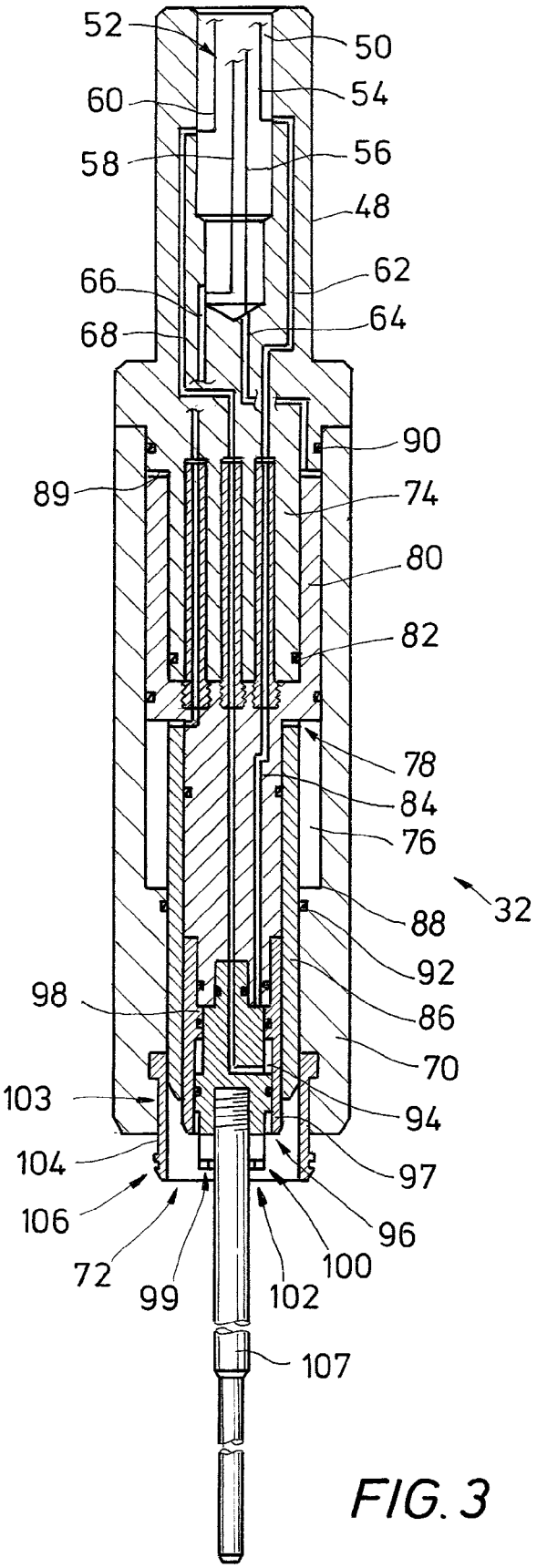
FIG. 3 is a side sectional view of an embodiment of an end effector portion of the plug tooling package of FIG. 1 and in accordance with the present invention.

FIG. 3 shows an example embodiment of end effector 32 in a side sectional view. In this example, end effector 32 includes an upper body 48, which is a generally cylindrically-shaped member whose radius projects radially outward in a region proximate a mid-portion of the body 48. A cylindrically-shaped cavity 50 extends from an end of upper body 48 to proximate the mid-portion of body 48. A fluid fitting 52 threadingly inserts into cavity 50 and is shown having flow lines 54, 56, 58, 60 that are spaced radially apart from one another and extend axially through fluid fitting 52. Flow lines 54, 56, 58, 60 respectively register with passages 62, 64, 66, 68 that are formed within upper body 48. End effector 32 further includes a lower body 70, which has a cylindrical outer surface and an axial bore 72 formed through the lower body 70. An end of upper body 48 distal from cavity 50 has a reduced radius to define a passage body 74, through which passages 62, 64, 66, 68 are formed. Passage body 74 inserts into bore 72, and has a radius smaller than an inner surface of bore 72; an annular space is formed between passage body 74 and bore 72 which defines a cylinder 76.

A piston assembly 78 is shown in the bore 72 and substantially coaxial with passage body 74. An upper end of piston assembly 78 has a cylindrical outer surface and opening on its end and defines a receptacle 80, in which passage body 74 is received. An outer surface of receptacle 80 is in contact with an inner surface of bore 72, seals 82 along on an outer circumference of receptacle provide a fluid barrier between the interface of the receptacle 80 and bore 72. A cylindrical piston throw 84 mounts on an end of the receptacle 80 and projects in a direction away from passage body 74. An annular collar 86 attaches to and circumscribes a portion of piston throw 84. Collar 86 extends from where piston throw 84 joins receptacle 80 to a location between receptacle 80 and a terminal end of piston throw 84 distal from receptacle 80. The radius of the bore 72 projects radially inward at a transition 88 so that the portion of bore 72 between transition 88 and its end distal from upper end 48 is adjacent an outer surface of collar 86. In the example of FIG. 3, transition 88 is in the lower half of bore 72 so that the axial length of cylinder 76 exceeds the axial length of receptacle 80; thereby allowing axial movement of receptacle 80 within cylinder 76, and thus axial movement of piston assembly 78 within lower body 70. The outer radius of upper body 48 is profiled radially inward and extends an axial distance in a direction away from cavity 50 to define a shoulder 89 shown inserted into an upper end of bore 72. Seats 90 on an outer circumference of shoulder 89 form a pressure barrier along the interface between upper body 48 and lower body 70.

Still referring to the example of FIG. 3, a channel 94 circumscribes an outer surface of piston throw 84 proximate its terminal end and distal from receptacle 80. A sleeve piston 96 has an annular body 97 which circumscribes a portion of piston throw 84 over channel 94; the sleeve piston 96 extends axially past opposite ends of channel 94. A piston head 98 projects radially inward from the body 97 and into channel 94, wherein the axial length of the piston head 98 is less than the channel 94. Piston sleeve 96 can axially reciprocate a designated distance in each direction until piston head 98 interferes with one end of channel 94. A latch assembly 99 is shown on a terminal end of piston throw 84 that extends axially outward in a direction away from receptacle 80. Latch assembly 99 includes a series of elongate cantilever members 100 having an end fixed in the piston throw 84, and a free end disposed axially past an end of piston throw 84. The cantilever members 100 are provided substantially along the entire circumference of the piston throw 84 and include a cantilever end 102 on their free ends that project radially inward.

Similar to the latch assembly 99 is a locking assembly 103 mounted on an outer surface of bore 72. Locking assembly 103 includes a plurality of elongate lock fingers 104 which have a base secured within outer wall of bore 72 and extend axially outward past the end of lower end 70 and distal from upper end 48. A finger end 106 is provided on the free end of each lock finger 104, which is a profiled element that projects radially outward. Also in FIG. 3, is an elongate cylindrical stinger 107 that mounts in the terminal end of piston throw 84 and projects axially outward therefrom. In an example, stinger 107 is used for actuating a check valve (not shown) in plug 20 when retrieving plug 20 from tubing hanger 22 (FIG. 1).

Figure 4:
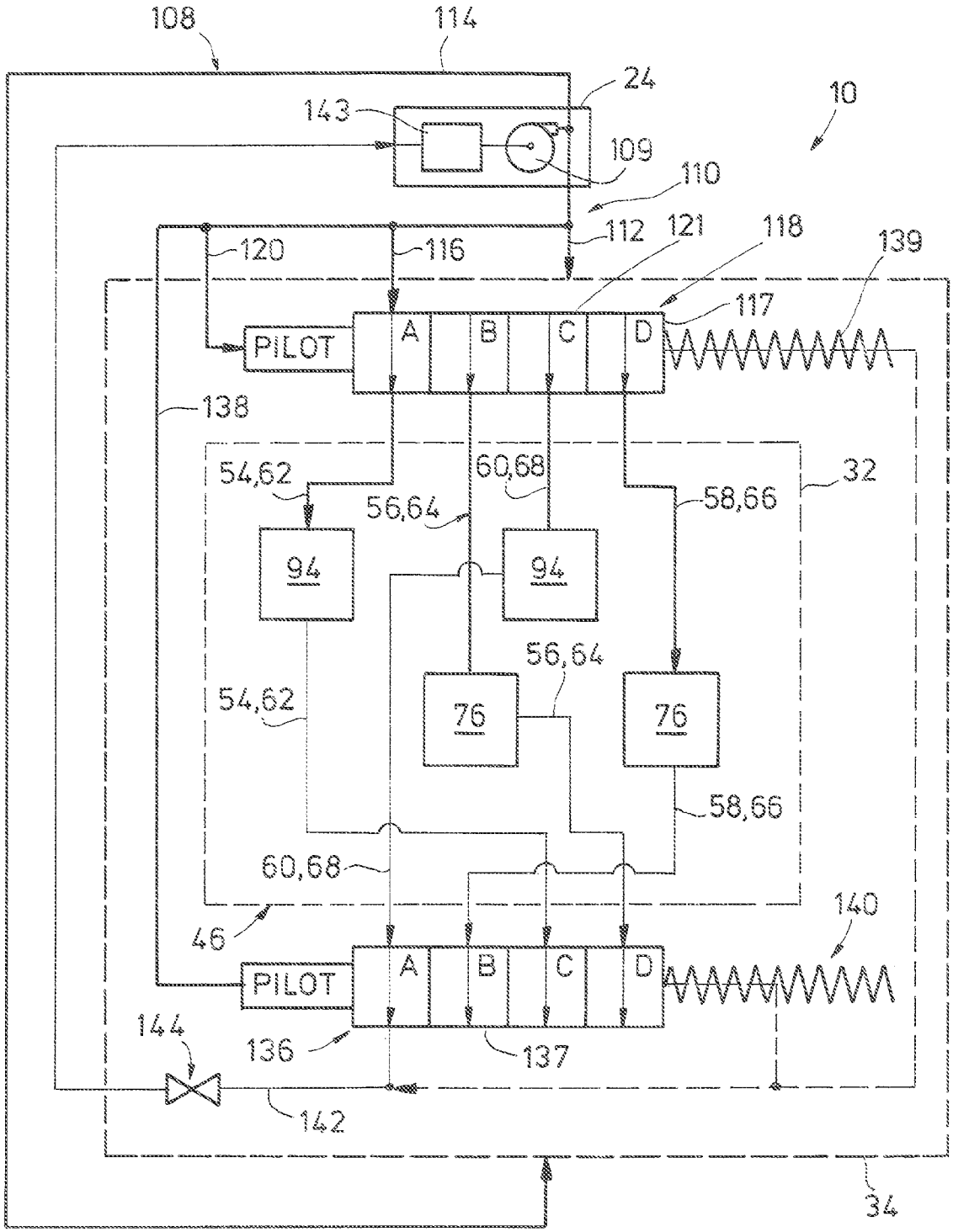
FIG. 4 is a schematic of an example embodiment of a hydraulic system for use in actuating the plug tooling package of FIG. 1 and in accordance with the present invention.

Referring now to FIG. 4, schematically illustrated is an example of a hydraulic circuit 108 that provides fluid communication between ROV 24, sequence valve 34, and components in the end effector 32 (FIG. 3). A pump 109 is shown disposed within ROV 24 for pressurizing hydraulic fluid that is delivered to the plug handling tool 10 via supply line 110. A piston stroke line 112 branches from supply line 110 and is directed to an upper end of piston 34. Referring back to FIG. 2, one optional means for delivering fluid from the piston stroke line 112 to piston 34 includes a port 113 shown formed through a sidewall of main tool body 28. Similarly, a piston retract line 114 is in communication with a discharge of pump 109 and directed to an opposite end of piston 34 for retracting piston 34. A port 115 (FIG. 2) is schematically illustrated for delivering fluid to lower chamber 40 for retracting piston 34 that in turn can retract end effector 32. Valving (not shown) is provided for selectively controlling an amount of flow into one of upper or lower chambers 38, 40 for reciprocating piston 34 and end effector 32 in a designated position.

Figure 5:
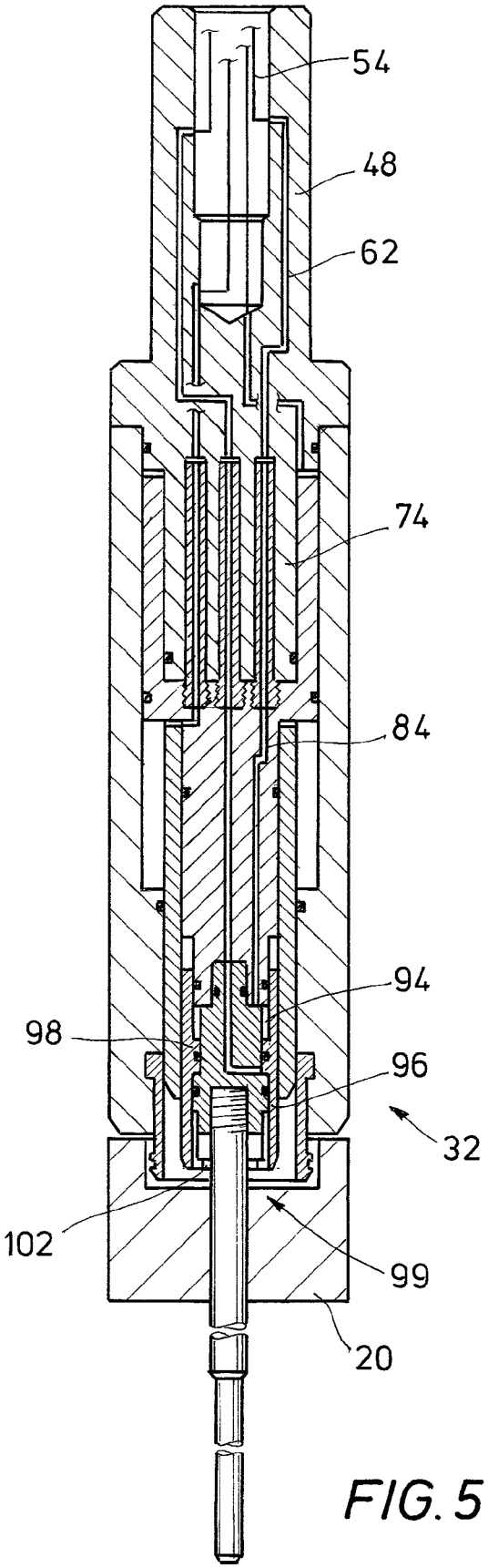
FIG. 5 is a side sectional view of the end effector portion of FIG. 3 actuated to latch to the plug and in accordance with the present invention.

Downstream from piston stroke line 112, a power supply line 116 branches from supply line 110 and is directed to a bore 117 in the piston 34 for housing a power supply valve 118. The bore 117 and power supply valve 118 make up part of sequence valve 46. Power supply valve 118 is schematically illustrated as a sequence valve having an inlet connected to power supply line 116, and four outlets that connect to portions of the end effector 32. Downstream from power supply line 116 is a pilot line 120 shown connected to a pilot member of power supply valve 118. Pilot member is pressure operated, and based on an input pressure from pump 109, pilot member selectively communicates the inlet of power supply valve 118 with one of its outlets. In one example, supplying fluid from the pump 109 at a first designated pressure and through pilot line 120 positions pilot so that fluid through power supply line 116 flows through sequence A and into flow line 54 and passage 62. In one example, power supply valve 118 is a spool element that moves within bore 117 for providing fluid communication from lines 116, 120, to one or more of lines 54, 56, 60 and/or passages 62, 64, 66, 68. Referring now to FIG. 5, passage 62 extends through the upper body, passage body 74, piston throw 84, and into channel 94. Providing fluid flow through this path imparts a force on piston head 98 that translates sleeve piston 96 from its position of FIG. 3 and axially away from upper body 48. In the position illustrated in FIG. 5, the body 97 of piston sleeve 96 circumscribes and moves radially inward the cantilever members 100 of latch assembly 99, to attach the end effector 32 to plug 20. Once attached to the end effector 32, the plug 20 can be deployed downhole into the tubing hanger 22. Conversely, the plug 20 can be latched onto when in the tubing hanger 22 and subsequently removed therefrom.

Figure 6:
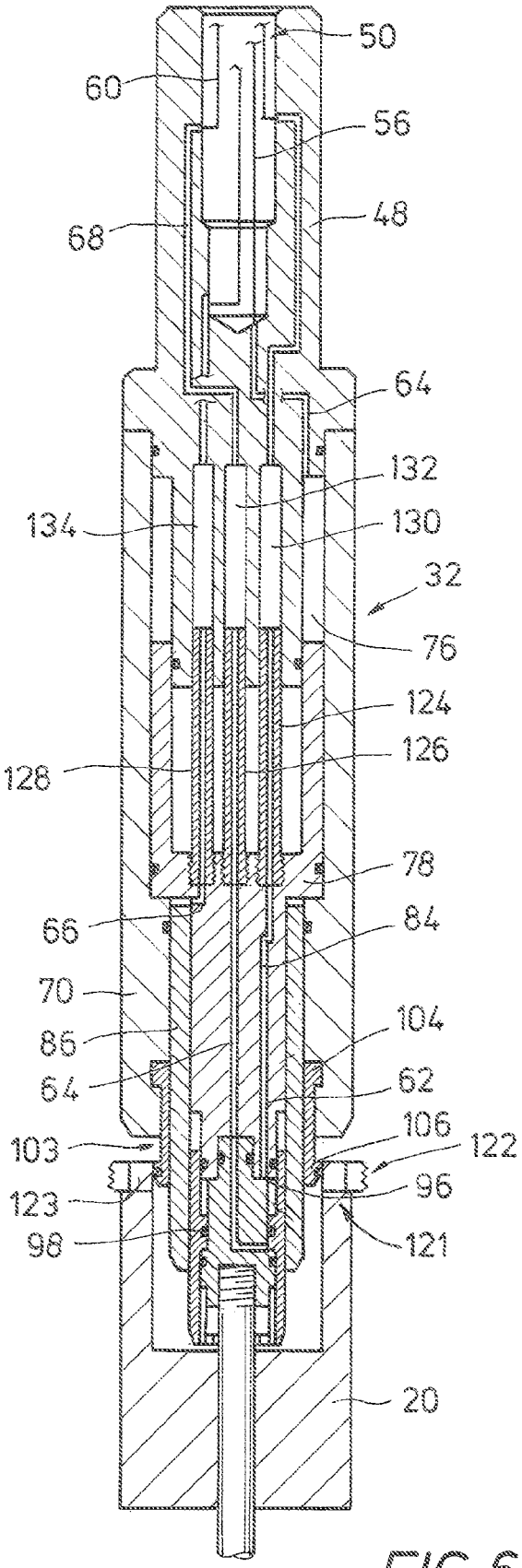
FIG. 6 is a side sectional view of the end effector portion of FIG. 5 actuated to deploy a latch from the plug and in accordance with the present invention.

Referring back to FIG. 4, adjusting pressure of fluid being discharged from pump 109 into pilot line 120 to a second designated pressure sequences power supply valve 118 to a position B. In position B fluid in power supply line 116 is diverted to an outlet connected to line 56 which flows into passage 64. As shown, passage 64 communicates with cylinder 76. Referring now to FIG. 6, passage 64 extends through upper body 48 an axial distance and is redirected to terminate at an end of cylinder 76 proximate cavity 50. Introducing fluid into cylinder 76 from passage 64 urges piston assembly 78 away from upper body 48, so that collar 86 is adjacent the lock fingers 104 of locking assembly 103. When plug 20 is attached to end effector 32, and collar 86 is set in the position of FIG. 6, collar 86 pushes the finger ends 106 radially outward to actuate a plug latch assembly 121 on plug 20 for anchoring plug 20 within tubing hanger 22 (FIG. 1). Included with the plug latch assembly 121 are plug latches 122 that project radially outward from plug 20 and into recesses (not shown) in tubing hanger 22. A lock sleeve 123 is schematically illustrated within plug 20 that is contacted by the finger ends 106 to deploy the plug latches 122 radially outward. It is believed it is within the capabilities of those skilled in the art to develop details for the plug latch 122 and lock sleeve 123 for proper anchoring of plug 20.

Figure 7:
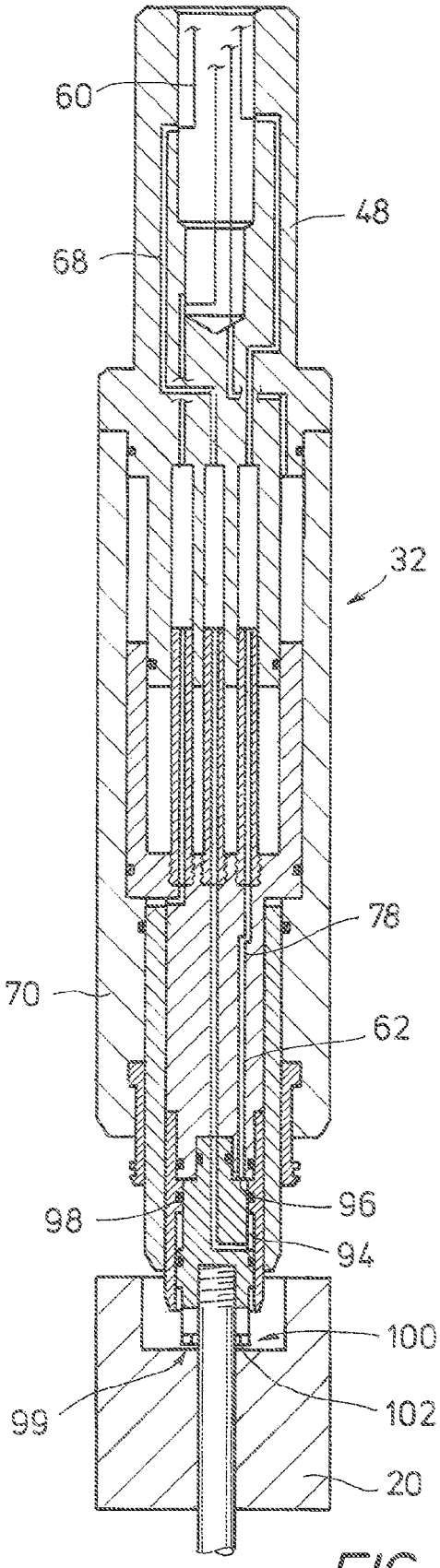
FIG. 7 is a side sectional view of the end effector portion of FIG. 7 actuated to release the plug and in accordance with the present invention.

Referring back to FIG. 4, when pump 109 delivers fluid at a third designated pressure pressure in pilot line 120 urges pilot to a position C. While in position C, power supply line 116 communicates with flow line 60 and passage 68 to deliver fluid to channel 94. As shown in FIG. 7, passage 68 extends from upper body 48 through piston assembly 78 into a side of channel 94 distal from line 62. Flowing fluid through flow line 60 and passage urges sleeve piston 96 axially away from plug 20, so that piston sleeve 96 no longer circumscribes latch assembly 99. As such, plug 20 can be released from end effector 32. This action may take place after landing an anchoring plug 20 within tubing hanger 22 (FIG. 1) or after having retrieved plug 20 from within the wellbore and disengaging plug 20 from end effector 32 above surface.

Referring now to FIG. 6, to accommodate fluid flow through the passages 62, 64, and 66 when the piston assembly 78 reciprocates away from upper body 48; tubes 124, 126, 128 are included that within passages 62, 64, 66 that each have an end fixed into a base of the receptacle that faces a terminal end of passage body 74. The tubes 124, 126, 128 have axial bores through their length that allow fluid flow. Free ends of the tubes 124, 126, 128 reciprocatingly insert into bores 130, 132, 134 that are formed axially into an end of the passage body 74 that faces the bottom of receptacle 80. Seals are shown on the outer circumference of tubes 124, 126, 128, to provide a pressure barrier against that prevents fluid in passages 62, 64, 66 from flowing into bores 130, 132, 134. In an example of operation, as piston assembly 78 moves axially away from upper body 48, the tubes slide within passages 130, 132, 134 away from cavity 50. The travel of the piston assembly 78 is less than the length of the tubes 124, 126, 128, so the free ends of the tubes 124, 126, 128 will remain in the bores 130, 132, 134 during the entire stroke of the piston assembly 78; and thereby maintain fluid communication across the separation of the passage body 74 and piston assembly 78.

Referring back to FIG. 4, operating pump 109 at a fourth designated pressure, the pilot is urged into a position D by pressure in pilot line 120, which communicates power supply line 116 with flow line 58 and passage 66. Thus while the power supply valve 118 of FIG. 4 is in position D, fluid from power supply line 116 is delivered to chamber 76 via passage 66. As shown in FIG. 3, passage 66 communicates with cylinder 76 in a side opposite from passage 64, and as such, retracts piston assembly 78 to its position of FIG. 3, thereby drawing plug 20 adjacent the lower terminal end of lower body 70. This is in contrast to the setoff distance between the lower end of lower body 70 and upper end of plug 20 as shown in FIG. 7. As such, selectively providing fluid to opposing ends of the receptacle and into cylinder 76 can reciprocate plug 20 proximate and distal from lower body 70.

Referring back to FIG. 4, also included with the sequence valve 46 is a vent circuit sequence valve 136 shown in a bore 137 in the piston 34, where the vent circuit sequence valve 136 can sequence in the same manner as power supply valve 118. In this example, sequencing of the vent circuit sequence valve 136 is controlled through pressure delivered in pilot line 138 which branches from supply line 110 downstream of pilot line 120. As shown, vent circuit sequence valve 136 has inlets that are respectively in communication with lines 60, 54, 58, and 56. Vent circuit sequence valve 136 has a single outlet that communicates with one of its inlets depending on the designated pressures delivered. The vent circuit sequence valve 136 of FIG. 4 is set to communicate with one of cylinder 76 or channel or 94, but on an opposite side of either receptacle 80 or piston head 98 from power supply valve 118. Thus when fluid flows through power supply valve 118 to urge receptacle 80 or sleeve piston 96 within cylinder 76 or channel 94, fluid present in cylinder 76 or channel 94 can be vented therefrom through vent circuit sequence valve 136 and allow movement of receptacle 80 and/or sleeve piston 96. In an example, pressure in the fluid from pump 109 is at a first designated pressure, power supply valve 116 and vent circuit sequence valve 136 are in position A, and in communication with channel 94, but on opposite sides of piston head 98. Thus as fluid into channel 94 from passage 62, fluid in channel 94 on an opposite side of piston head 98 can be emptied from channel 94 and into passage 68.

Springs 139, 140 are shown respectively coupled with power supply valve 116 and vent circuit sequence valve 136. In an example, springs 139, 140 retract the pilot into a blocked or no flow position when less than a operational designated pressure is present in pilot lines 120, 138. Further illustrated in FIG. 4, is a vent line 142 that connects to an outlet of vent circuit sequence valve 136 for transporting fluid exiting vent circuit sequence valve 136 back to a tank 143 shown disposed in ROV 24, wherein an inlet to pump 109 is fed by flow line from tank 143. Vent circuit sequence valve 136 can be a spool element, that when selectively moved within bore 137 can provide communication from lines 58, 60 and/or passages 66, 68 to line 142. An optional isolation valve 144 is shown in vent line 142 for isolating vent line 142 from tank 143. In an example, the second designated pressure is greater than the first designated pressure, the third designated pressure is greater than the second designated pressure, and the fourth designated pressure is greater than the third designated pressure. In another example, the first designated pressure is around 500 psig, the second designated pressure is around 1000 psig, the third designated pressure is around 1500 psig, and the fourth designated pressure is around 2000 psig.

Referring back to FIG. 2, optionally, the latch assembly 99A can be a series of dogs that project radially outward and connect on an inner circumference of plug 20. Similarly, locking assembly 103A can project in direct communication with plug latch assembly 121 for deploying plug latches 122 radially outward into contact with tubing hanger 22 (FIG. 1).

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A tool for handling a plug in a subsea wellhead assembly comprising:

a tool main body having a cylinder in selective fluid communication with a fluid source;

an end effector having a latch in selective engagement with the plug and a coupling assembly in selective mechanical cooperation with a latch assembly in the plug;

a piston moveably disposed within the cylinder;

a stem connected between the piston and the end effector, so that when fluid is introduced into the cylinder the end effector is axially moveable with movement of the piston; and a pressure controlled sequence valve in the piston that is in selective fluid communication with the latch and the coupling assembly.

2. The tool of claim 1, wherein the pressure controlled sequence valve comprises, a bore in the piston having, an inlet in fluid communication with a fluid source, a latch outlet in fluid communication with the latch, and a coupling assembly outlet in fluid communication with the latch assembly, and a spool element slidable in the bore that is selectively sequenced to a position where there is fluid communication between the inlet and the latch outlet and that extends along a flow path that is transverse to the spool element, and selectively sequenced to a position where there is fluid communication between the inlet and coupling assembly outlet and that extends along a flow path that is transverse to the spool element, and wherein when the inlet and latch outlet are in fluid communication, fluid communication between the inlet and coupling assembly outlet is blocked by the spool element.

3. The tool of claim 2, wherein the spool element is in fluid communication with the fluid source, wherein the position of the spool element corresponds to a pressure of the fluid in the fluid source, and wherein flow paths extend transverse through the spool element, so that by selectively pressurizing an end of the spool element with a designated pressure the spool element is strategically disposed so that the flow paths register with flow lines that are in fluid communication with the fluid source and with flow lines that are in communication with one of the latch or the coupling assembly, so that strategic positioning of the spool element selectively provides fluid communication between the fluid source and a one of the latch or the coupling assembly and selectively blocks fluid communication between the fluid source and a one of the latch or the coupling assembly.

4. The tool of claim 1, wherein the fluid source comprises a remotely operated vehicle.

5. The tool of claim 1, wherein the fluid source supplies fluid at selective pressures.

6. The tool of claim 2, wherein the bore comprises a first bore, and the spool element comprises a first spool element, and wherein the first bore and the first spool element define a power supply valve, the pressure controlled sequence valve further comprising, a second bore in the piston having a latch inlet in fluid communication with the latch, a coupling assembly inlet in fluid communication with the coupling assembly, an outlet in fluid communication with a storage tank, and a second spool element slidable in the second bore that is selectively sequenced to a position where there is fluid communication between the outlet and the latch inlet and to a position where there is fluid communication between the outlet and coupling assembly inlet.

7. The tool of claim 6, wherein when fluid flows from the second bore, fluid is urged from a chamber in the end effector and routed to an inlet of the second bore that is in fluid communication with the outlet of the second bore.

8. The tool of claim 2, wherein the latch outlet comprises an actuating latch outlet, the tool further comprising a deactuating latch outlet in the bore that is in fluid communication with the latch, so that when the spool element is positioned in the bore so that the inlet in fluid communication with the actuating latch outlet, fluid flows to the latch to couple the plug to the end effector, and so that when the spool element is positioned in the bore so the inlet is in fluid communication with the deactuating latch outlet, fluid flows to the latch to decouple the plug from the end effector.

9. The tool of claim 2, wherein the coupling assembly outlet comprises a locking actuator outlet, the tool further comprising an unlocking actuator outlet in the bore that is in fluid communication with the coupling assembly, so that when the spool element is positioned in the bore so the inlet is in fluid communication with the locking actuator outlet, fluid flows to the coupling assembly to anchor the plug to a tubing hanger, and so that when the spool element is positioned in the bore so the inlet is in fluid communication with the unlocking actuator outlet, fluid flows to the coupling assembly to disengage the plug from the tubing hanger.

10. A method of handling a plug in a subsea wellhead assembly comprising:

a. providing a plug handling tool having a tool body having a chamber, a piston in the chamber, and a stem connecting the piston to an end effector that couples to the plug, the plug handling tool further having a plug latch, a plug anchor system, and a pressure actuated power supply valve located in the piston that has an inlet, and has an outlet in communication with a plug latch actuator, and an outlet in communication with the plug anchor system;

b. coupling the plug to the plug handling tool by supplying fluid to the power supply valve at a pressure that sequences the power supply valve to a position so the inlet is in communication with the outlet in communication with the plug latch actuator;

c. inserting the plug into the subsea wellhead assembly; and d. anchoring the plug in the subsea wellhead assembly by supplying fluid to the power supply valve at a pressure that sequences the power supply valve to a position so the inlet is in communication with the outlet in communication with the plug anchor system.

11. The method of claim 10, further comprising providing a vent valve having an inlet in communication with the plug latch actuator, an inlet in communication with the plug anchor, and an outlet in communication with a storage tank, and that is sequenced in response to the supply of fluid of step (b).

12. The method of claim 11, further comprising selectively venting fluid through the vent valve to storage, wherein the fluid is evacuated from the plug latch actuator in response to fluid flowing from the power supply valve.

13. The method of claim 10, wherein the fluid is supplied by a remotely operated vehicle disposed subsea.

14. The method of claim 10, wherein the tool further comprises, the method further comprising supplying fluid in the chamber to selectively move the piston, stem, and end effector in an axial direction.

15. The method of claim 10, wherein the pressure that sequences the power supply valve to a position comprises a first pressure and the position comprises a first position, the method further comprising supplying a second pressure to the power supply valve that is greater than the first pressure, and wherein the step of supplying the second pressure to the power supply valve sequences the power supply valve so that the inlet is in communication with a sleeve for unlatching the plug from the plug handling tool.

16. A tool for handling a plug in a subsea wellhead assembly comprising:

a tool body having a cavity that is in fluid communication with a remotely operated vehicle (ROV);

an end effector coupled with the tool body having a plug latch system and a plug anchoring system;

a piston axially moveable within the cavity; and a sequence valve system in the piston comprising:

a power supply valve having an inlet, a first outlet and a second outlet respectively in fluid communication with the plug latch system and the plug anchoring system, and a pilot member selectively sequenced in response to a pressure of fluid supplied by the ROV to a first position where the inlet is in communication with the first outlet and to a second position where the inlet is in communication with the second outlet, and a vent valve having an outlet, a first inlet and a second inlet respectively in fluid communication with the plug latch system and the plug anchoring system, and a pilot member selectively sequenced in response to a pressure of fluid supplied by the ROV to a first position where the outlet is in communication with the first inlet and to a second position where the outlet is in communication with the second inlet.

17. The tool of claim 16, further comprising a stem mounted on an end of the piston that attaches to the end effector, so that when fluid is supplied to a side of the piston, the stem and the end effector are axially moved.

18. The tool of claim 16, wherein the plug latch system comprises elongated latching fingers that attach to the plug when fluid flows from the first outlet.

19. The tool of claim 16, wherein the plug anchoring system comprises members that selectively extend radially outward when fluid flows from the second outlet.

* * * * *